US007624984B2

(12) United States Patent
Martineck, Sr.

(10) Patent No.: US 7,624,984 B2
(45) Date of Patent: Dec. 1, 2009

(54) LOTTERY GAME CARD HAVING DUAL IMAGED INDICIA WITH SCRATCH-OFF LAYER

(75) Inventor: Jeffrey D. Martineck, Sr., Alpharetta, GA (US)

(73) Assignee: Scientific Games International, Inc., Newark, NJ (US)

( * ) Notice: Subject to any disclaimer, the term of this patent is extended or adjusted under 35 U.S.C. 154(b) by 97 days.

(21) Appl. No.: 11/777,476

(22) Filed: Jul. 13, 2007

(65) Prior Publication Data

US 2008/0042346 A1 Feb. 21, 2008

Related U.S. Application Data

(60) Provisional application No. 60/839,050, filed on Aug. 21, 2006.

(51) Int. Cl.
*A63F 3/06* (2006.01)

(52) U.S. Cl. ..... 273/139; 273/269; 283/901; 283/903

(58) Field of Classification Search ..... 273/139, 273/269; 283/901, 903
See application file for complete search history.

(56) References Cited

U.S. PATENT DOCUMENTS

| | | | | |
|---|---|---|---|---|
| 4,212,468 | A | 7/1980 | Knott | |
| 5,074,566 | A | 12/1991 | Desbiens | |
| 5,193,815 | A | 3/1993 | Pollard | |
| 5,544,881 | A * | 8/1996 | Rua et al. | 273/139 |
| 6,241,246 | B1 * | 6/2001 | Guttin et al. | 273/139 |

* cited by examiner

*Primary Examiner*—Benjamin H Layno
(74) *Attorney, Agent, or Firm*—Dority & Manning, P.A.

(57) ABSTRACT

A scratch off lottery game card including a substrate on which a plurality of original game indicia are printed on a substrate, and a replica set of the original game indicia is placed on the top of the original game indicia in a scratch-off material covering the same. The replica game indicia and original game indicia are preferably in contrasting colors to be visually different from each other.

8 Claims, 2 Drawing Sheets

LOTTERY GAME CARD HAVING DUAL IMAGED INDICIA WITH SCRATCH-OFF LAYER

PRIORITY CLAIM

The present application claims filing benefit of U.S. provisional patent application Ser. No. 60/839,050 filed on Aug. 21, 2006.

FIELD OF THE INVENTION

The invention relates to a lottery game and, more specifically, relates to a scratch-off lottery game card that easily shows a player's selected game indicia.

BACKGROUND OF THE INVENTION

A typical scratch-off game card for a bingo game has a game area with a plurality of pre-printed game letters and a player area with some pre-assigned letters. The game letters in the game area are usually visible to the player, while the pre-assigned letters in the player area are usually covered by an opaque removable layer. A player purchases a scratch-off bingo game card and removes the opaque removable layer to reveal the pre-assigned letters. When the player identifies a pre-assigned letter in the player area that matches a game letter from the game area, the player marks the game letter to identify it as a matched letter. The player can mark a game letter with a pen or pencil.

However, to make marking easier for the players, the game letters are usually covered by a layer of removable material and on the top of the layer the same set of game letters are printed. The player removes the layer of removable material, generally a latex layer, by using his fingernail or a coin. The removal of the latex layer on the top of a game letter provides an indication that the game letter has been "called." The player actually can feel the latex layer when rubbing his fingernail over the lottery game card. When rubbed by a coin or fingernail, a small amount of the latex layer breaks into particles and collapses from the layer, thus revealing the pre-printed game letter below.

The latex layer is usually placed with a two-step process. The first step places an opaque layer covering the game indicia and the second step prints the original game indicia on the top of the opaque layer. This process presents a latent problem caused when a different set of game indicia is placed on the top of the original game indicia by mistake. The mistake will typically not be detected until the scratch-off game card is purchased and used by a player.

Therefore, it is desirable to have a scratch-off lottery game card that allows player to mark indicia yet minimize the risk of printing mistakes and it is to such method the present application is primarily directed.

THE SUMMARY OF THE INVENTION

Objects and advantages of the invention will be set forth in part in the following description, or may be obvious from the description, or may be learned through practice of the invention.

In one embodiment, there is provided a scratch-off lottery game card on which a plurality of game indicia are printed on a substrate and a replica set of the game indicia is printed or placed, as a removable material on the top of the original game indicia covering them entirely. The replica game indicia are preferably slightly larger than the original game indicia and a starkly contrasted color from the original game indicia to be easily distinguished. The replica game indicia are printed using an easily removable material and to be removed through scratching action. After the replica indicia are removed, the original game indicia, underneath, in a contrasting color are revealed.

In another exemplary embodiment, a game card is provided that includes a substrate, a player indicia area, game indicia area, and a plurality of player indicia positioned in the player indicia area. A plurality of game indicia are positioned in the game indicia area. A plurality of replica indicia are each positioned over a matching game indicia so as to cover the plurality of game indicia. The plurality of replica indicia comprise a layer of material removable by a player of the game card so as to reveal an underlying game indicia. In a variation, the plurality of replica indicia may be applied as slightly larger than the underlying game indicia and/or may also have a different color than the plurality of game indicia. An opaque material may be used to cover the plurality of player indicia, wherein the opaque material is removable so as to reveal the player indicia. For example, the opaque material may include a polymer-based material that is removable by rubbing or scratching. The plurality of game indicia may be arranged into predetermined patterns within a grid. The plurality of game indicia and the plurality of player indicia may include alphanumeric characters and/or other types if indicia. The player indicia and game indicia may each comprise alphanumeric characters, with at least one of the characters of the play indicia matching at least one of the characters of the game indicia.

In still another exemplary embodiment, a game card is provided that includes a substrate adapted to be printed upon. A player area is located upon the substrate and has at least one player indicia printed thereon. A game area is also located upon the substrate and has at least one game indicia printed thereon. At least one replica indicia is located in the game area that matches the at least one game indicia, and the replica indicia is placed onto the game indicia so as to cover the game indicia. The replica indicia is removable by a player of the game card.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DETAILED DESCRIPTION

Figure 1:
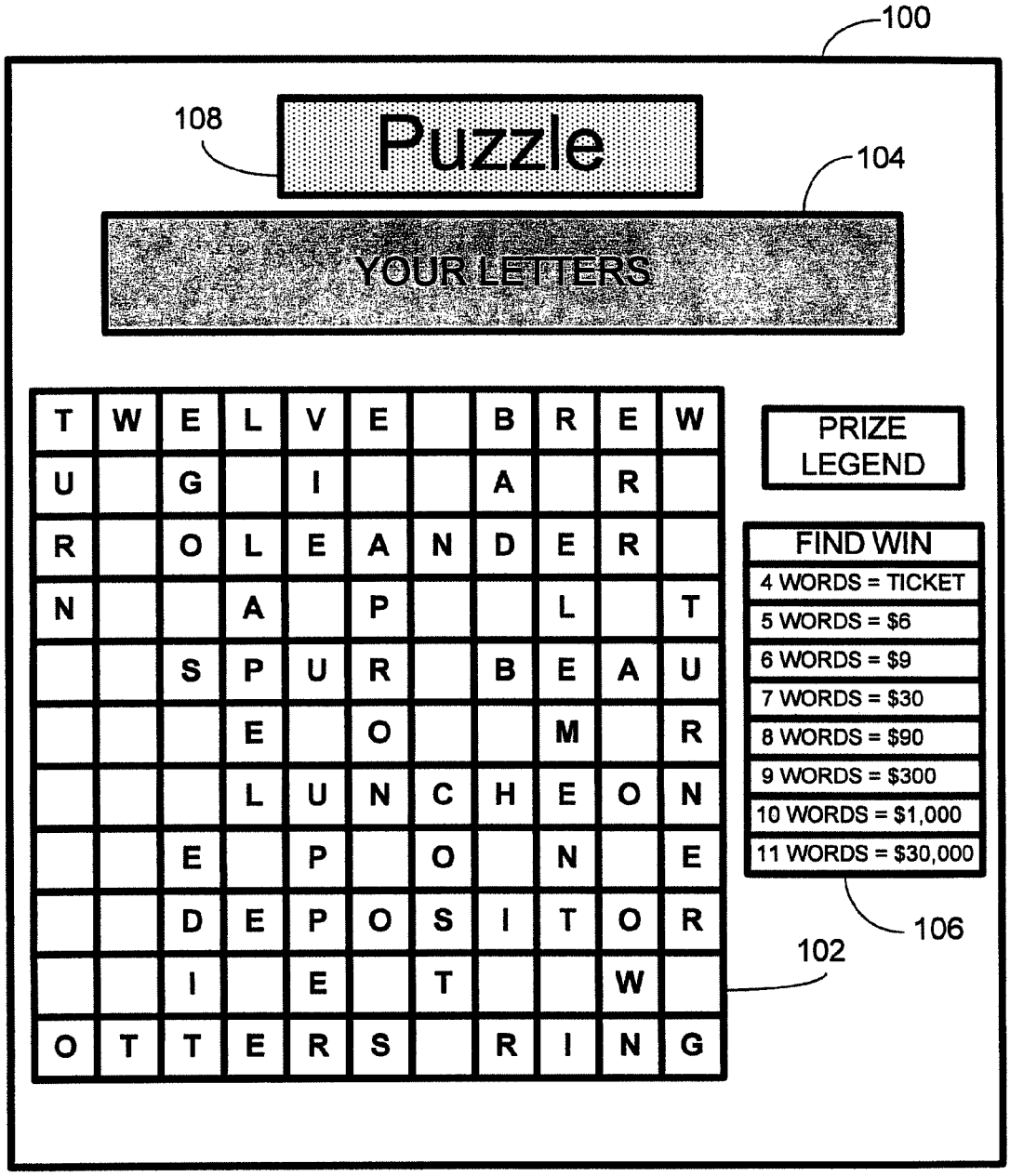
FIG. 1 illustrates a scratch-off game card according to one embodiment of the invention.

Briefly described, in one embodiment, the invention is a lottery game card in which a set of predefined game indicia is printed on a substrate and a replica set of the predefined game indicia is placed on the top of the original set via a scratch-off material to cover the original set. The original set of game indicia and the replica set are easily distinguishable from each other through color contrast; so if the placement of the replica set is defective, it can be easily detected. When a player scratches off a replica game indicia covering an original game indicia, the game indicia underneath is revealed. FIG. 1 illustrates a lottery game card 100 for a word puzzle game according to one embodiment of the invention. The lottery game card 100 includes a game indicia area 102 that includes a plurality of squares arranged in a matrix format, and some of squares having a letter in it and forming some words or predefined patterns. The lottery game card 100 also includes a player indicia area 104 labeled as "YOUR LETTERS" in which certain letters (player indicia) are printed and covered by a removable opaque material, such as a polymer-based layer that breaks into particles or collapses from the layer when scratched so that a portion of the layer can be removed leaving the letter underneath intact. The lottery game card 100 further includes a prize area 106, wherein a list of prizes is listed.

A player can purchases a lottery game card 100 at any lottery game retailer. After purchasing the lottery game card 100, the player scratches off the player indicia area 104 labeled as "YOUR LETTERS" to reveal the pre-assigned letters. After revealing the letters, the player can then match each letter listed in the player indicia area 104 with letters in the game indicia area 102. To track and easily identify the letters in the game indicia area 102 that match the letters in the player indicia area 104, the player scratches off the replica game indicia from the square having a letter that matches a letter in the player indicia area 104. The scratched area reveals the original game indicia, which is visually different from the replica game indicia, preferably by being a contrasting color from the replica game indicia, and thus making easily observable by the human eye. If the player matches a number of words that is listed in the prize area 106, then the player wins the prize that matches the number of words.

The game card 100 comprises a simple flat substrate of a suitable card stock material on which printing can be received, generally of paper. Onto the substrate is printed a first area having a plurality of squares in the game indicia area 102, a second area 108 with the game title, a player indicia area 104 with a pre-assigned letters, and a fourth area 106 listing prizes. After the first area is printed with an original set of game indicia in the squares, a replica set of the game indicia is placed on the top of the original set of game indicia preferably as a removable material, such as latex or other polymer. The game indicia in the replica set is preferably slightly larger than the game indicia in the original set. When the game indicia in the replica set is placed on the top of the game indicia in the original set, the replica game indicia covers the original game indicia. If the replica game indicia is different from the original indicia, the replica game indicia will not be able to cover the game indicia underneath. The original game indicia may have a color different from the replica game indicia, thus making it easier to identify any mismatch between the replica game indicia and the original indicia. The different color appearance between the replica game indicia and original indicia also makes easier for a player to distinguish removal of the scratch-off replica game indicia.

Figure 2:
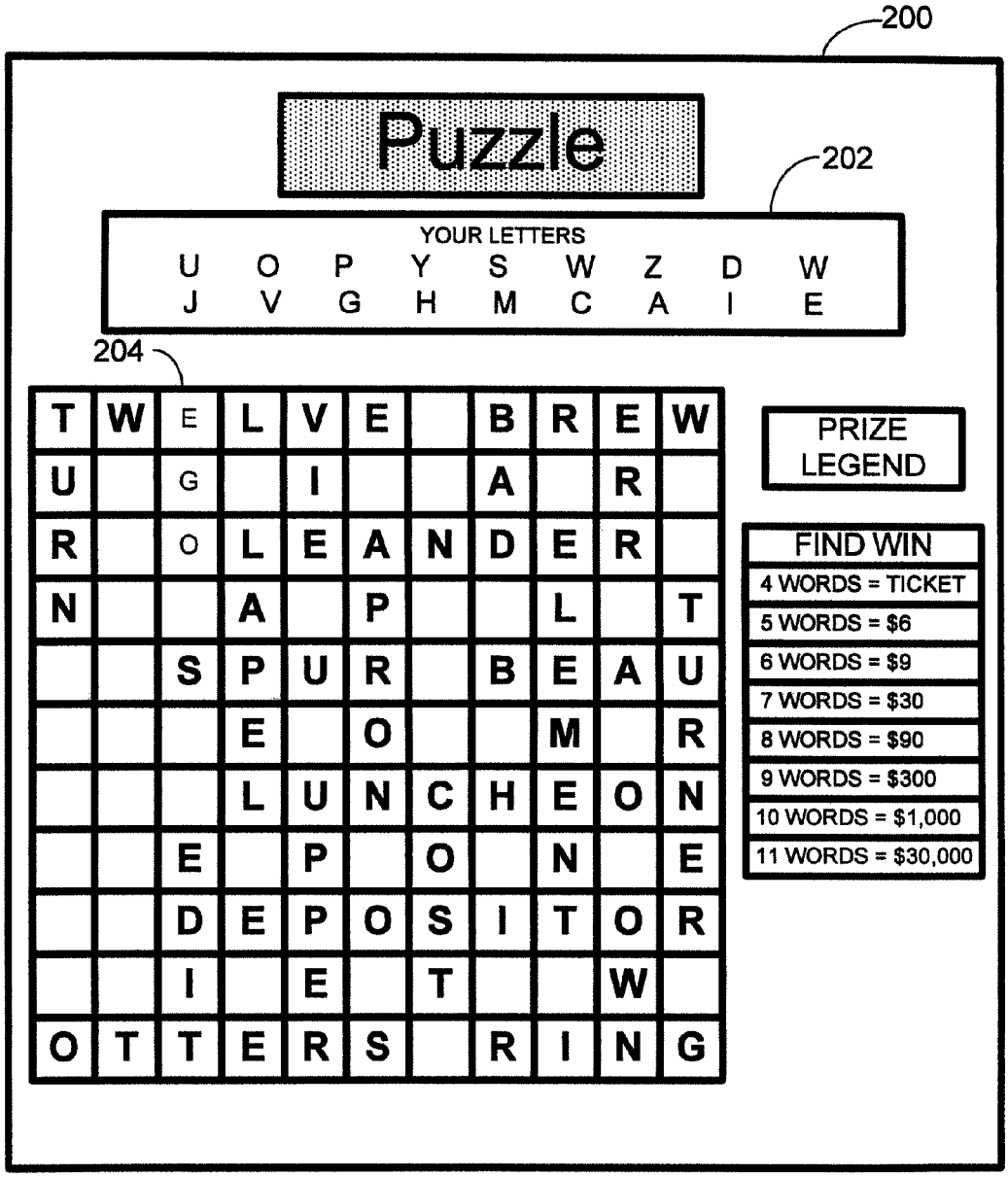
FIG. 2 illustrates the scratch-off game card of FIG. 1 with a few spots having game indicia scratched.

FIG. 2 illustrates a lottery game card 200 that illustrates a game card with the pre-assigned player indicia in the player area 202 revealed and few game indicia in the game area 204 scratched off. Because the replica game indicia, "E," "G," and "O" have been scratched off and the original game indicia in red color are revealed, the player can now easily identify the word he has formed so far.

In this embodiment, the lottery game card includes a substrate, a game indicia area, and a player indicia area. The game indicia area includes a plurality of original game indicia forming a plurality of predefined patterns. A replica set of the original game indicia is placed on the top of the original game indicia covering the original game indicia, wherein each replica indicia of the replica set covers a like original game indicia.

Although preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms are employed herein, they are used in a generic and descriptive sense only, and not for the purposes of limiting the described invention.

What is claimed is:

1. A game card comprising:

a substrate;

a player indicia area;

game indicia area;

a plurality of player indicia positioned in said player indicia area;

a plurality of game indicia positioned in said game indicia area; and a plurality of replica indicia, wherein each said replica indicia is positioned over a matching said game indicia so as to cover said plurality of game indicia, wherein each said plurality of replica indicia comprises a layer of removable material having a visually distinct characteristic as compared to said game indicia and is applied over said game indicia in a replica shape of and aligned with said game indicia so that any differences between said replica indicia and the underlying said game indicia are visually apparent without removing said replica indicia.

2. The game card of claim 1, wherein each of said plurality of replica indicia are slightly larger than the underlying said game indicia.

3. The game card of claim 2, wherein said plurality of replica indicia have a different color than said plurality of game indicia.

4. The game card of claim 1, wherein said plurality of replica indicia have a different color than said plurality of game indicia.

5. The game card of claim 1, wherein said removable material is an opaque material.

6. The game card of claim 1, wherein said plurality of game indicia are arranged into predetermined patterns within a grid.

7. The game card of claim 1, wherein said plurality of game indicia and said plurality of player indicia comprise alphanumeric characters.

8. The game card of claim 1, wherein said player indicia and said game indicia each comprise alphanumeric characters, and wherein at least one of said characters of said play indicia matches at least one of said characters of said game indicia.

* * * * *